US006210215B1

(12) United States Patent
Hwang

(10) Patent No.: US 6,210,215 B1
(45) Date of Patent: Apr. 3, 2001

(54) PANEL MOUNT ELECTRICAL CONNECTOR ASSEMBLY

(75) Inventor: Jeng-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/449,108

(22) Filed: Nov. 24, 1999

(51) Int. Cl.[7] ..... H01R 13/74
(52) U.S. Cl. ..... 439/545; 439/564
(58) Field of Search ..... 439/545, 564, 439/939, 76.1

(56) References Cited

U.S. PATENT DOCUMENTS 5,306,175 * 4/1994 Swanstrom ..... 439/564
5,320,554 * 6/1994 Freer et al. ..... 439/545

* cited by examiner

*Primary Examiner*—Gary F. Paumen
(74) *Attorney, Agent, or Firm*—Wei Te Chung

(57) ABSTRACT

A panel mount electrical connector assembly for mounting on a panel of an instrument, includes a pair of specific screws, a traditional connector unit, and an insulative outer housing. Each of the specific screws has a front head exposed out of the outer housing for being driven, and a rear head movably restricted within the outer housing from being removed out thereby movably building the screws in the connector assembly without possibility of loss. The panel is defined with a plurality of cutouts each divided into a wide region and a narrow region communicated with each other. In assembly, the front heads of the screws of the connector assembly removably enter through the wide regions of the corresponding cutouts of the panel, firstly. Then, the front heads are successively moved along but restricted from being removed out the narrow regions of the same cutouts thereby firmly, conveniently and speedily securing the electrical connector assembly to the panel as long as driving the screws in.

1 Claim, 12 Drawing Sheets

PANEL MOUNT ELECTRICAL CONNECTOR ASSEMBLY

BACKGROUND OF THE INVENTION

1. Field of the Invention

The present invention relates to an electrical connector assembly, and particularity to a panel mount connector electrical assembly for securing to a panel of an electric instrument.

2. The Prior Art

In conventional connector assemblies mounted to a panel of an electric instrument like a computer chassis, a first type connector as introduced in U.S. Pat. Nos. 4,820,180, 4,988,308, 5,017,151, 5,049,092, 5,249,982, 5,514,000, 5,525,074, 5,575,673, 5,632,648, 5,766,041, 5,895,289, 5,931,688 and RE 34,430 presents the claw-like or sealed securement of the connector to the panel. However, the process of interference-fitting the connector through an opening defined on the panel may have the claw/seal permanently deformed in fitting dimension. The incorrect/change of fitting tolerance may loose the securement of the connector to the panel. A mating action of an external connector may forcedly push the connector assembly out of the panel, consequently.

A second type connector as introduced in U.S. Pat. Nos. 4,678,259, 5,228,865, 5,254,010, 5,709,569, 5,772,471, 5,924,877, and Des. 415,106 presents the direct-screwed securement of the connector to the panel for enhancement of the retention. However, the manual pre-alignment among several different screwed holes defined on the connector assembly, the mating connector and the panel, and the usage of the external and separate screws easily causes the securement of the connector inconvenient and time-consuming.

A third type connector as introduced in U.S. Pat. No. 5,766,035 presents two lugs 8*a*, 8*b* for pre-alignment of the connector with the panel before being screwed thereto. However, it is anticipated that its corresponding mating connector must be a specific one additionally installed with two screws. Other common mating connectors without additional screws are not suitable for the third type connector. Also, the screws solely driven inside the mating connector are possibly lost in delivery because of the removability of the screws from the mating connector.

SUMMARY OF THE INVENTION

Accordingly, one object of the present invention is to provide a panel mount electrical connector assembly having at least a specific screw moveably secured therein for firmly, conveniently and speedily securing the electrical connector to a panel of an electrical instrument like a computer chassis.

Another object of the present invention is to provide the panel mount electrical connector assembly having the movable built-in specific screws without possibility of loss.

Another object of the present invention is to provide a panel of an electrical instrument like a computer chassis with a plurality of cutouts for cooperation with the screw of the connector assembly for conveniently and speedily screwing the electrical connector to the panel.

To fulfill the above mentioned objects, according to several embodiments of the present invention, a panel mount electrical connector assembly for mounting on a panel of an instrument, includes an insulative outermost housing, a pair of specific screws, and a traditional connector unit linking with a bunch of cables.

The outer insulative housing is defined with an upper and lower covers each which has a pair of first passageways for reception of the screws. A stop portion is integrally swelled within each of the first passageways and has a deep cave defined thereon. Each of the specific screw has a threaded shaft and two heads at opposite ends of the threaded shaft. A fixture portion is screwed on the shaft but restricted between the heads of each screw.

When the specific screws are assembled within one of the covers, the front head of each of the screws is exposed out of the cover for being driven. And, the rear head is movably restricted within the corresponding first passageway by the stop portion from removal of the entire screw out of the outer housing. The fixture portion is fixedly located within the cave of the outer housing thereby cooperating with the threaded shaft of the corresponding screw to adjustably move the screw in/out. Therefore, these screws are movably built in the outer housing of the connector assembly without possibility of loss.

The panel consists of opposite front and rear surfaces, a first cutout and a second cutout respectively defined through both surfaces of the panel. Each of the cutouts is divided into a wide region and a narrow region communicated and dimensioned with regard to the wide region.

In attachment of the electrical connector assembly to the panel, the front heads of the specific screws are firstly moved to removably enter through the wide regions of the corresponding cutouts. Then, the front heads are successively moved along but restricted from being removed out the narrow regions of the same cutouts thereby easily and speedily screwing the electrical connector assembly to the panel as long as driving the screws in.

BRIEF DESCRIPTION OF THE DRAWINGS

FIG. 10 is attached into the panel.

DETAILED DESCRIPTION OF THE PREFERRED EMBODIMENTS

Detailed reference will now be made to the preferred embodiments of the present invention.

Figure 1:
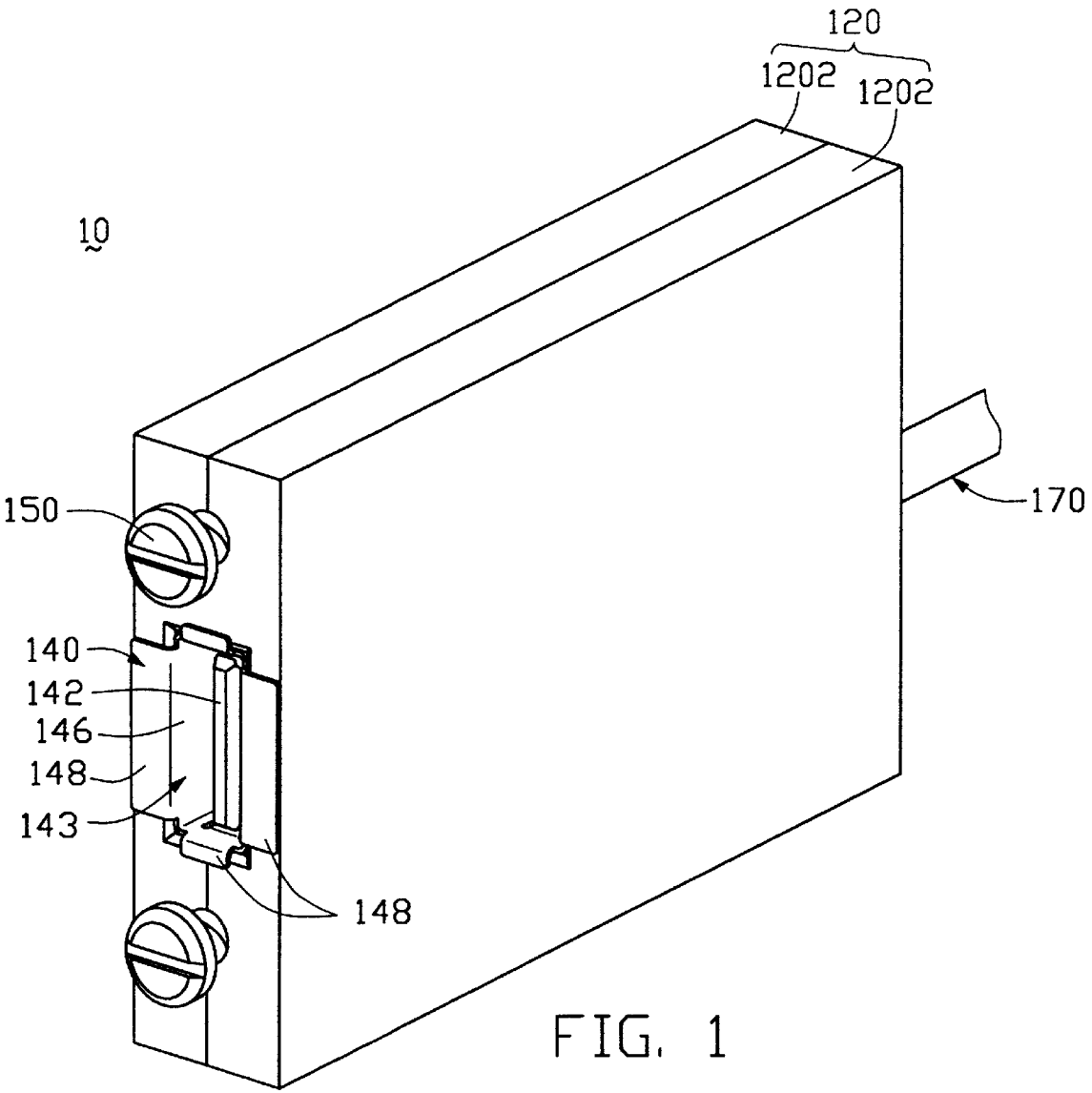
FIG. 1 is a front perspective view of a panel mount electrical connector assembly of a first preferred embodiment in accordance with the present invention.
Figure 4:
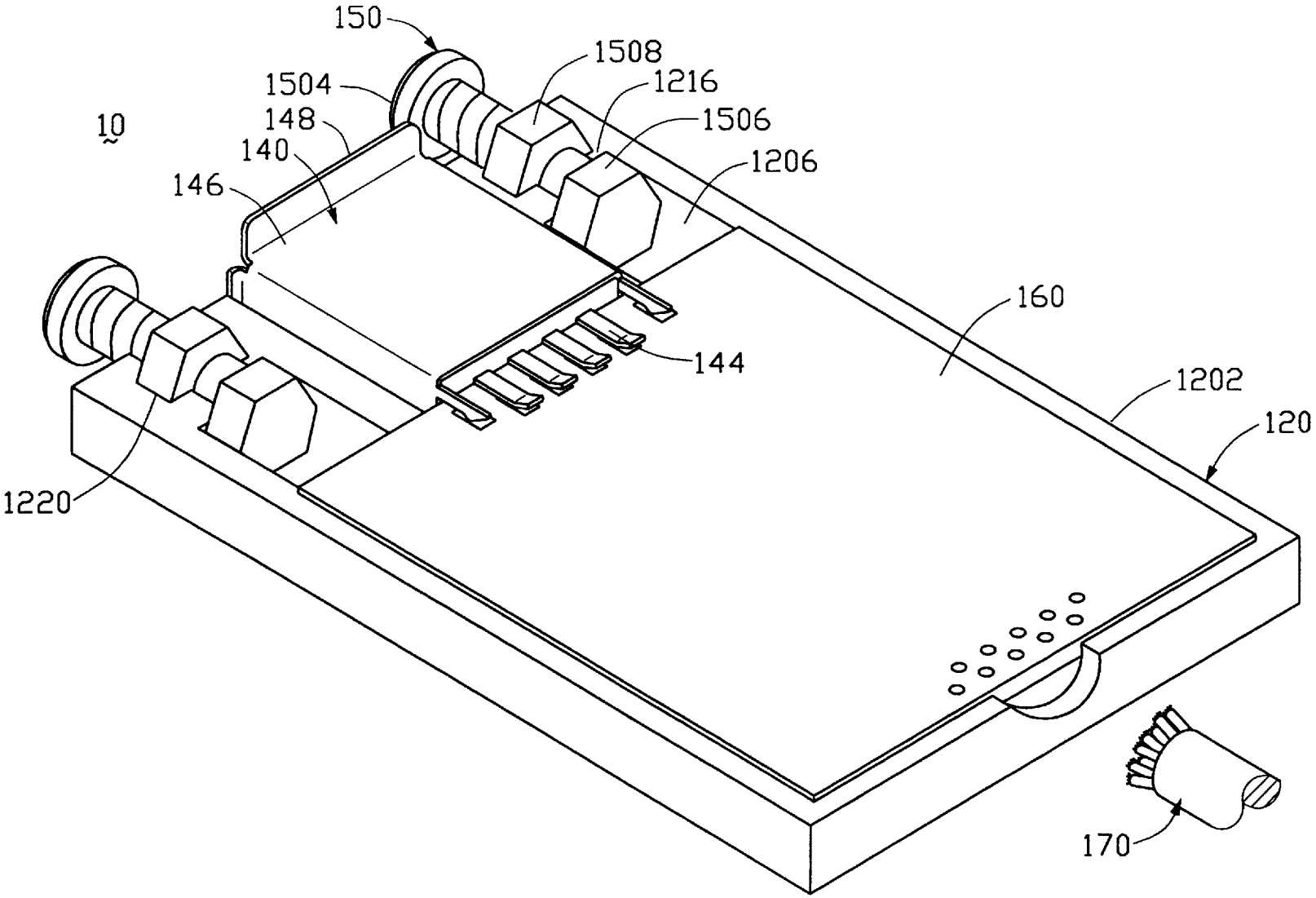
FIG. 4 is a sub-assembled perspective view of the panel mount electrical connector assembly of FIG. 1.

Referring to FIGS. 1 & 4, a panel mount electrical connector assembly 10 in accordance with a first preferred embodiment of the present invention for coupling with a mating connector (not shown), includes an insulative outermost housing 120, a connector unit 140, a pair of specific screws 150, and a bunch of cables 170. Meanwhile, the connector unit 140 is optionally designated to be a standard connector like an USB (Universal serial Bus) connector, which is capable of coupling alone with the mating connector beside used in the electrical connector assembly 10. Such a standard connector unit 140 commonly has an inner insulative housing 142 defining a mating opening 143 therein for receiving the mating connector, a plurality of contacts 144 disposed within the inner housing 142, and an inner conductive shell 146 used to shield around the outside of the inner housing 142. The inner shell 146 further integrally forms a plurality of grounding tabs 148 extending around a mating surface of the connector unit 140. As shown in FIG. 4, the circuit board 160 is used to electrically interconnect between the contacts 144 of the connector unit 140 and the cables 170.

Figure 2:
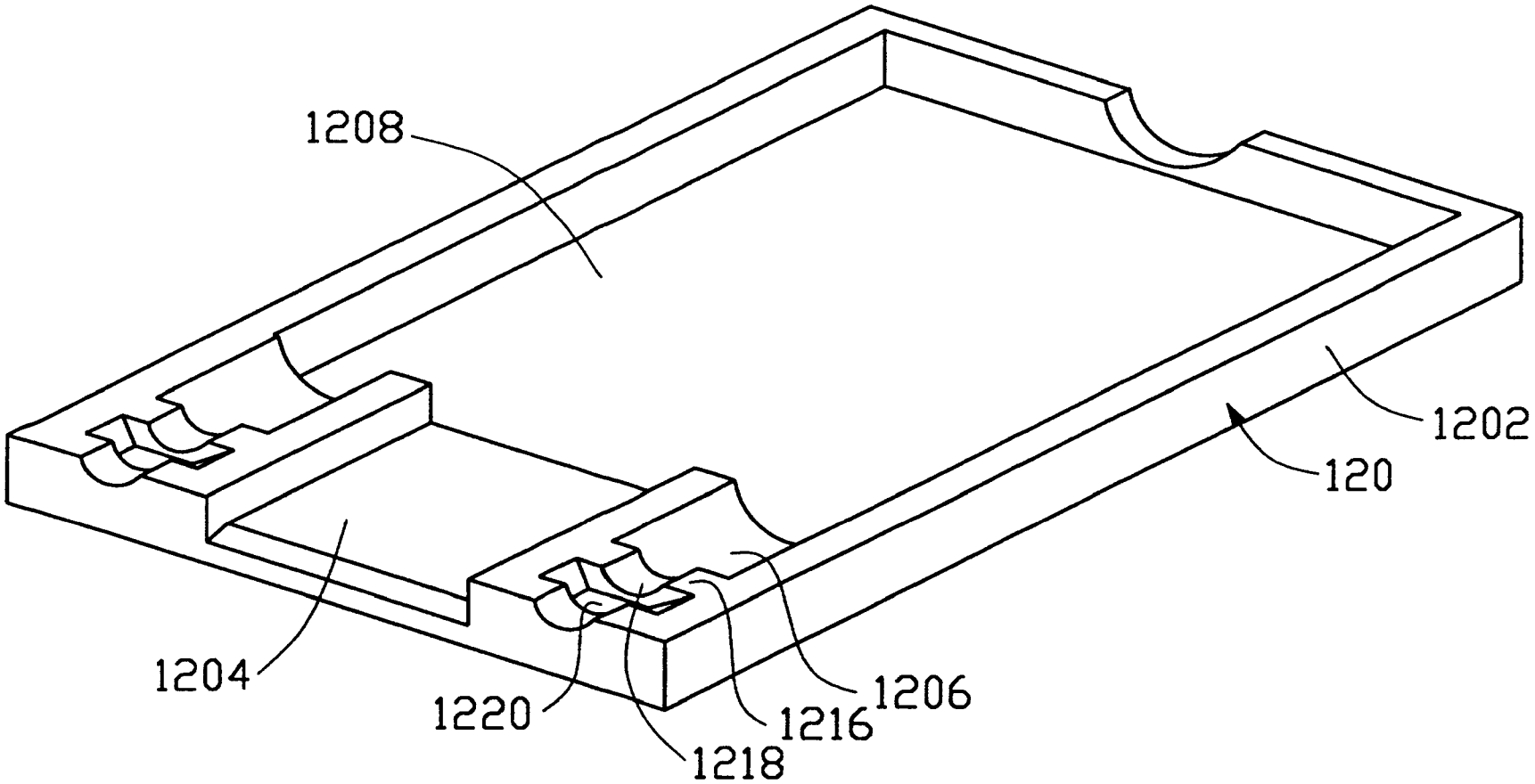
FIG. 2 is a front perspective view of a cover used in the panel mount electrical connector assembly shown in FIG. 1.

The outer insulative housing 120 is defined with a upper and lower covers 1202 which are the same as shown in FIG. 2 for convenience of fabrication. Each of the cover 1202 as shown in FIGS. 2 & 4 forms a platform 1204 adjacent a front end thereof for reception of the connector unit 140. A pair of first passageways 1206 is integrally located at opposite sides of the platform 1204, along a front-to-rear direction for reception of the screws 150. A pit 1208 is defined at rear portion of the platform 1204 for reception of the circuit board 160. A stop portion 1216 is integrally swelled within each of the first passageways 1206 in position adjacent to the front end of the same cover 1202. A second passageway 1218 defined above each stop portion 1216 is dimensioned smaller than the corresponding first passageway 1218. A deep recess 1220 is defined at central region of each of the stop portion 1216 to cut the corresponding second passageway 1218 off.

Figure 3:
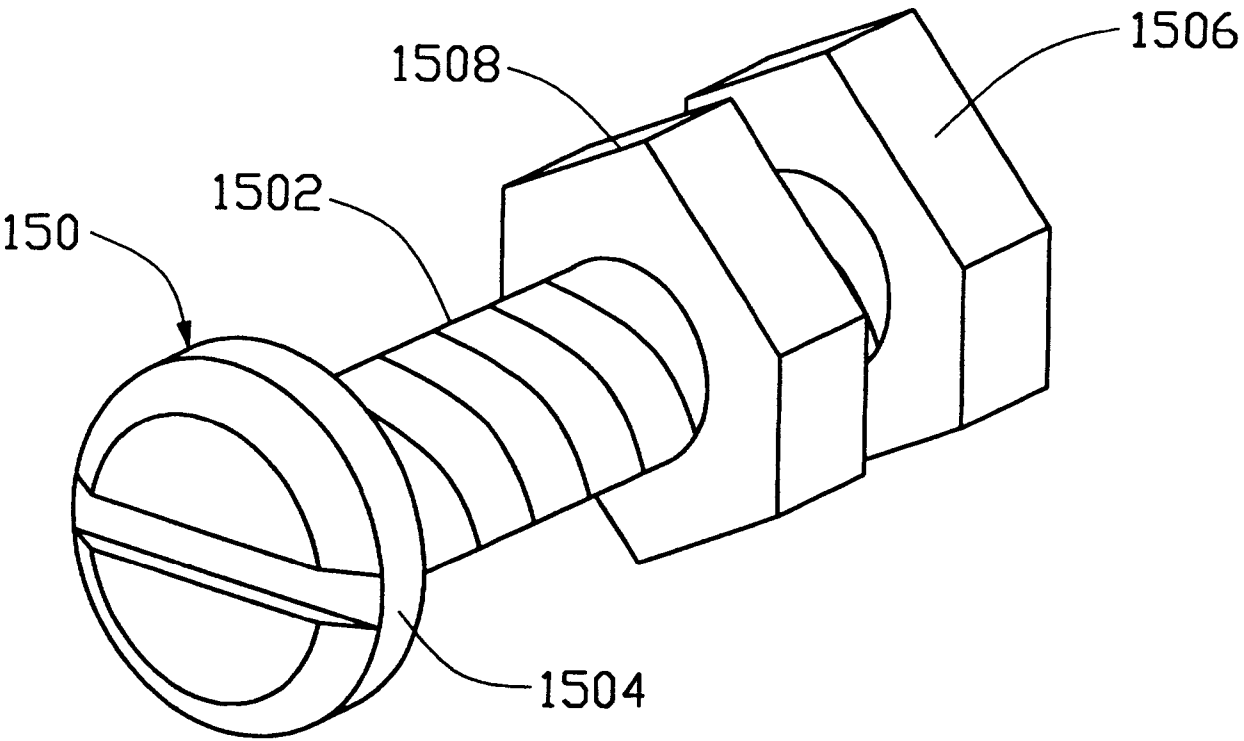
FIG. 3 is a front perspective view of a screw used in the panel mount electrical connector assembly shown in FIG. 1.

Further referring to FIG. 3, the specific screw 150 is fabricated to have a threaded shaft 1502 and two heads 1504, 1506 wider than the shaft 1502, located at opposite ends of the shaft 1502. A fixture portion 1508 with an inner thread like a nut is screwed on the threaded shaft 1502 but restricted between the heads 1504, 1506 of the screw 150. Optionally, the rear head 1506 is shaped by soldering another nut to the rear end of the screw 150, or by a stamping process to deform the rear end of the screw 150. In assembly of the screws 150 within the cover 1202 of the outer housing 120 as shown in FIG. 4, the front head 1504 of each of the screws 150 is exposed out of the cover 1202 for being driven. When the front head 1504 is driven, the rear head 1506 is movably restricted within the corresponding first passageway 1206 by the stop portion 1216 from removal of the entire screw 150 out of the outer housing 120. The fixture portion 1508 is fixedly located within the cave 1220 of the outer housing 120 thereby cooperating with the threaded shaft of the screw 150 to adjustably move the screw 150 in/out. Therefore, these screws are movably built in the outer housing of the connector assembly without possibility of loss. Then, the sub-assembled lower cover 1202 and the upper cover 1202 are combined, as the result shown in FIG. 1, where the connector unit 140 and the circuit board 160 are fully enclosed almost except the grounding tabs 148 for electrical contact with a panel 20 shown in FIG. 5. The efficient retention between both covers 1202 is optionally built by an ultrasonic welding.

Figure 5:
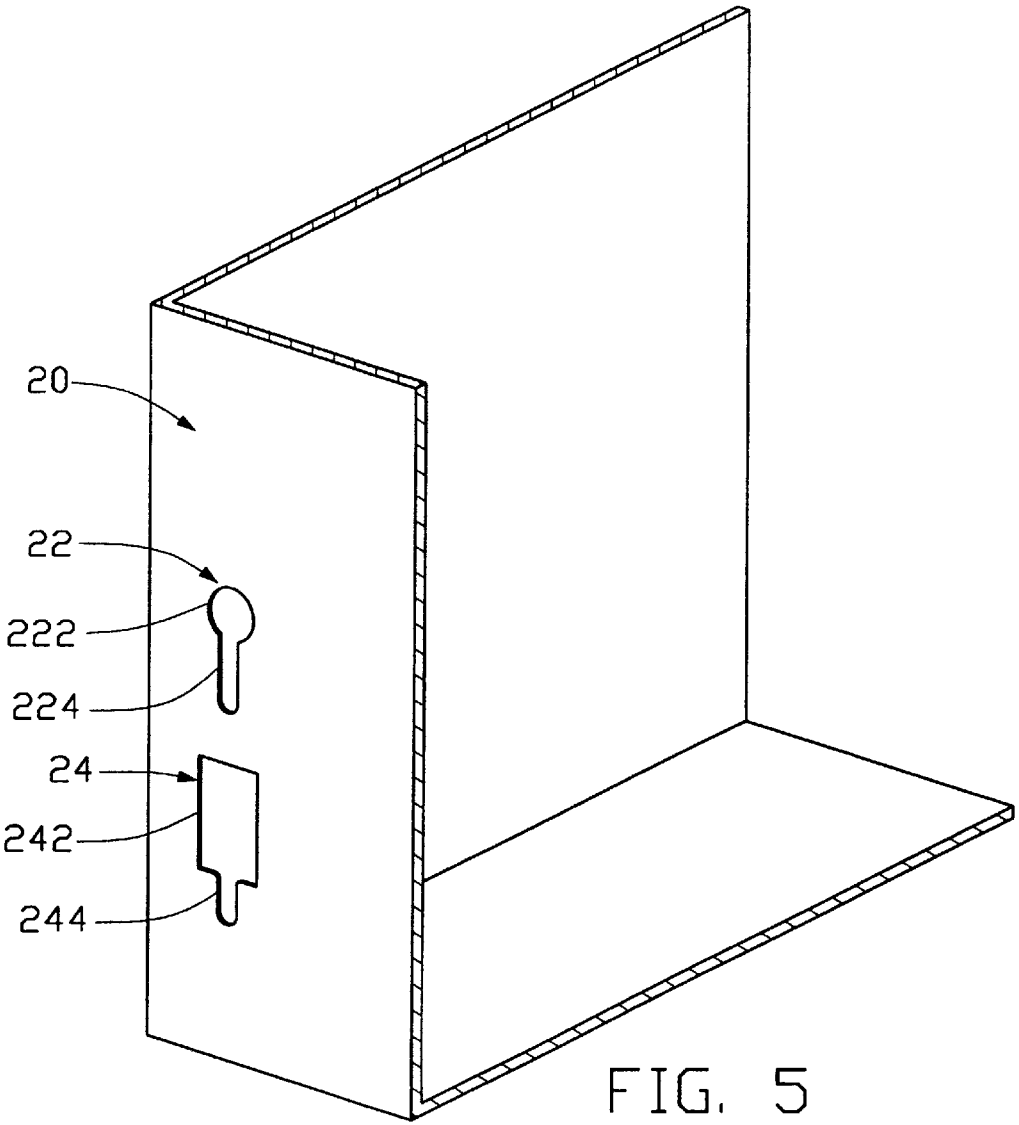
FIG. 5 is a front perspective view of a panel for used with the panel mount electrical connector assembly of FIG. 1.

The panel 20 shown in FIG. 5 serves for an electrical instrument like a computer, and consists of opposite front and rear surfaces. A first cutout 22 and a second cutout 24 are respectively defined through both surfaces of the panel 20, each is divided into a wide region 222, 242 and a narrow region 224, 244 communicated below with and dimensioned smaller than the wide region 222, 242 in width. Beside, the wider region 242 of the second cutout 24 is dimensioned sufficient to permit entrance/removal of the mating connector for coupling with the electrical connector assembly 10.

Figure 6:
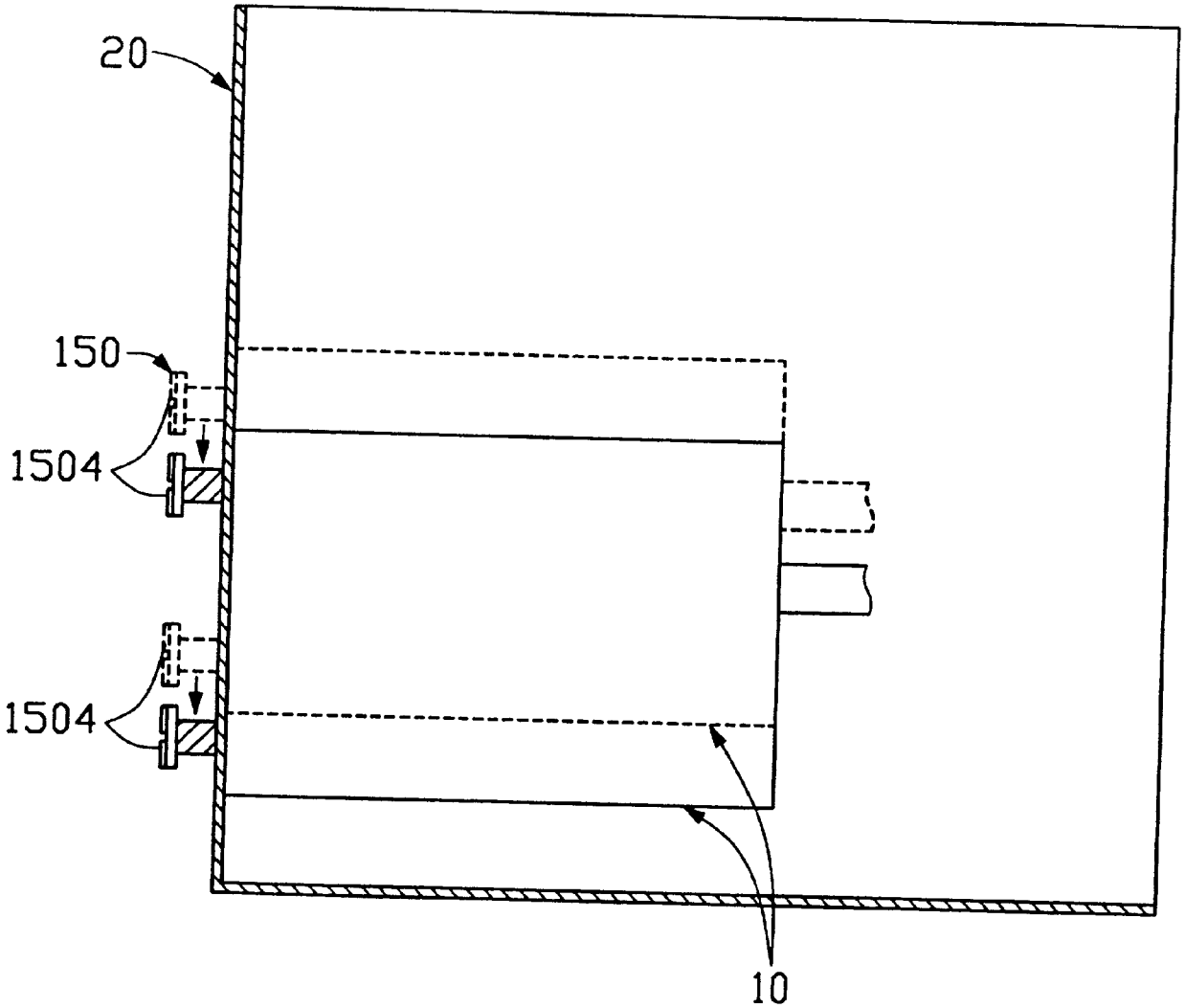
FIGS. 6–7 show the assembly of the panel mount electrical connector assembly of FIG. 1 with the panel of FIG. 5.
Figure 7:
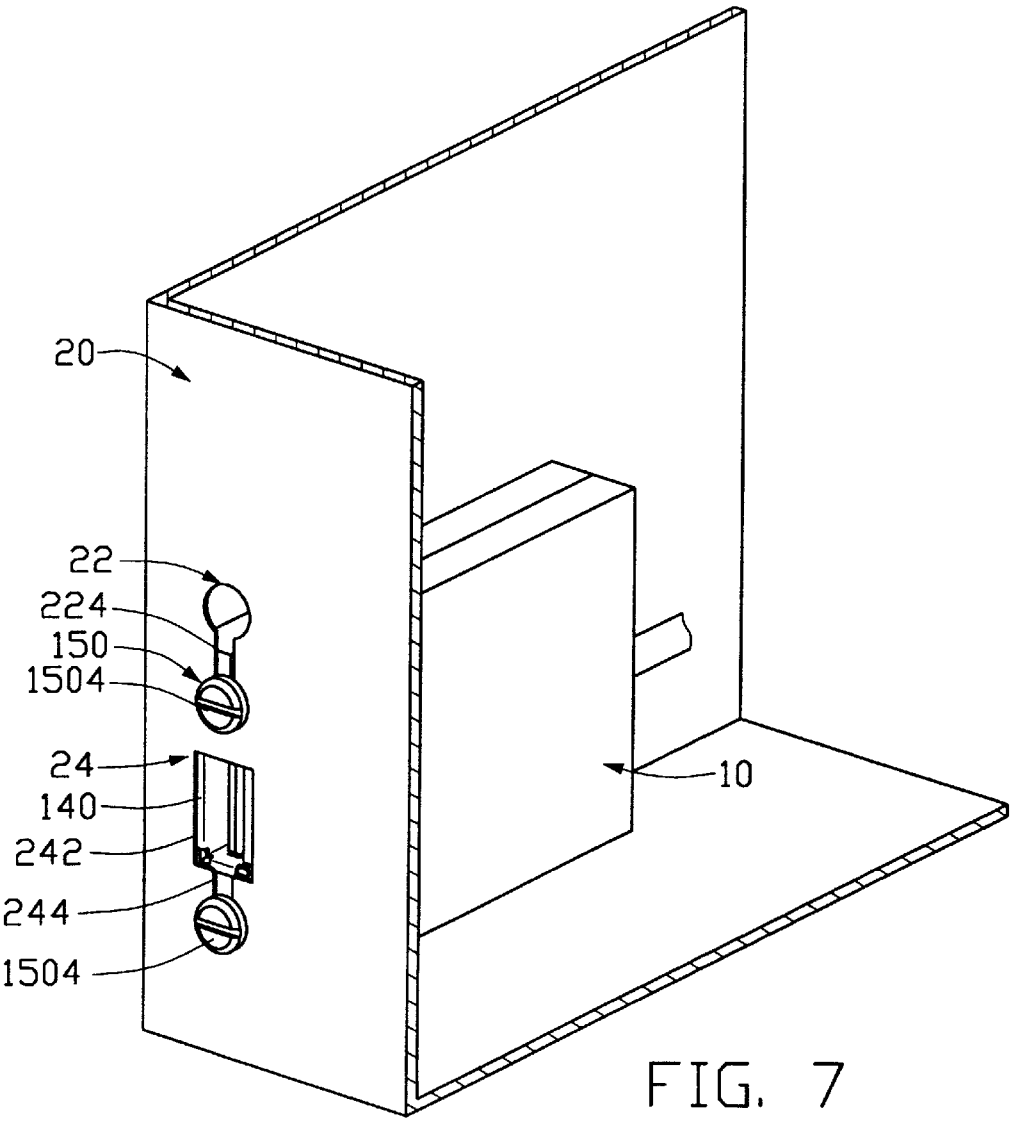

In assembly of the electrical connector assembly 10 with the panel 20 as shown in FIGS. 5 & 6, the front heads 1504 of the specific screws 150 are firstly moved to removably enter through the wide regions 222, 242 of the corresponding cutouts 22, 24 so that the front heads 1504 are exposed outside the panel 20 in opposition to the surface where the electrical connector assembly 10 is disposed. Then, the front heads 1504 are successively moved along the narrow regions 224, 244 of the same cutouts 22, 24 while being restricted from being removed therefrom due to hooking relationship between the heads 1504 and the narrow regions 224, 244. This is because each of the front heads 1504 is dimensioned larger than the narrow region 224, 244 of the corresponding cutout 22, 24 in width but the threaded shafts 1502 are dimensioned smaller or equal to the cutouts 22, 24. Accordingly, any one user can easily and speedily screw the electrical connector assembly to the panel as long as driving the screws 150 in, as the result shown in FIG. 7. Meanwhile, it is understood that the mating surface of the connector unit 140 of the connector assembly 10 is aligned with the wide region 242 of the second cutout 24 for coupling with the mating connector. It is appreciated that a resilient dimple portion may be optionally formed around the distal end of the narrow regions 224, 244 for preventing inadvertently moving the screw 150 in a reverse direction along the narrow regions 224, 244 when the screw 150 has not been fully driven to its final fixed position.

Figure 8:
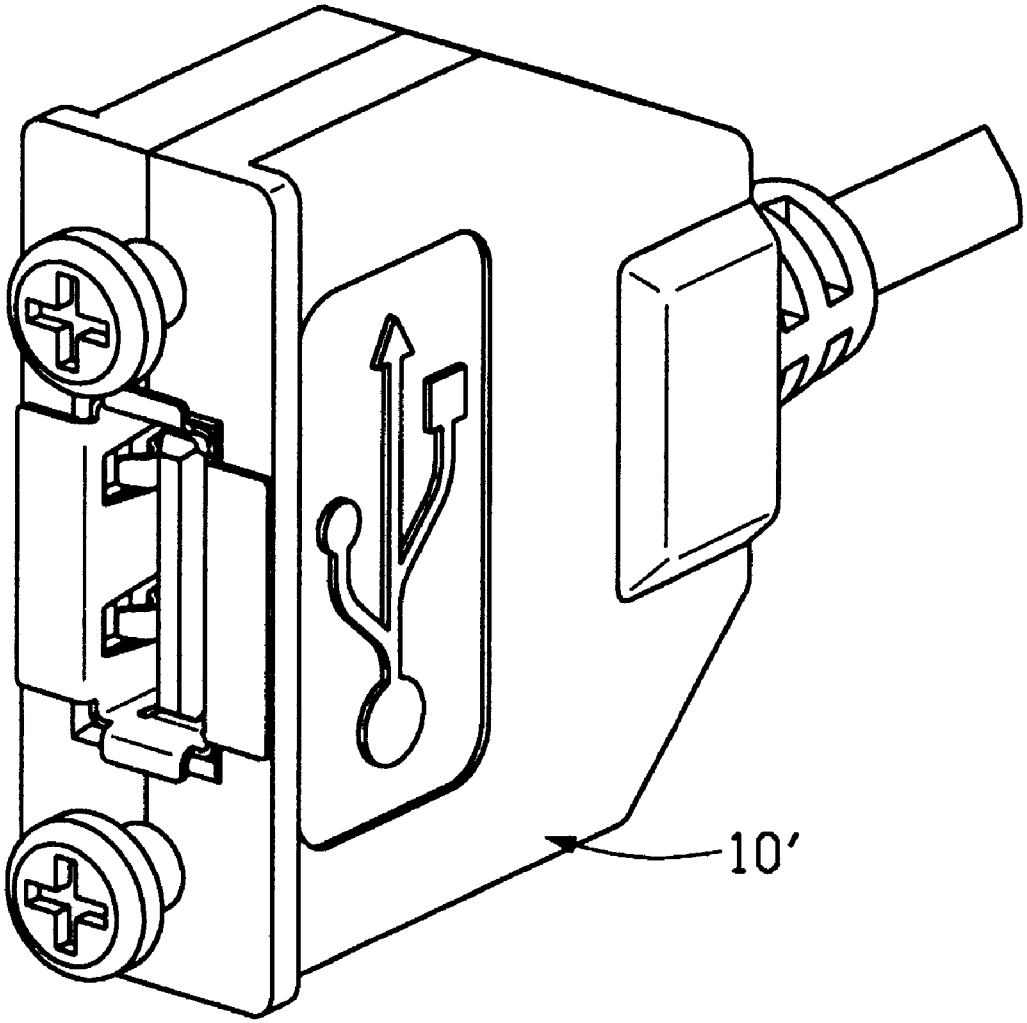
FIG. 8 is a front perspective view of a panel mount electrical connector assembly of a second preferred embodiment in accordance with the present invention.
Figure 9:
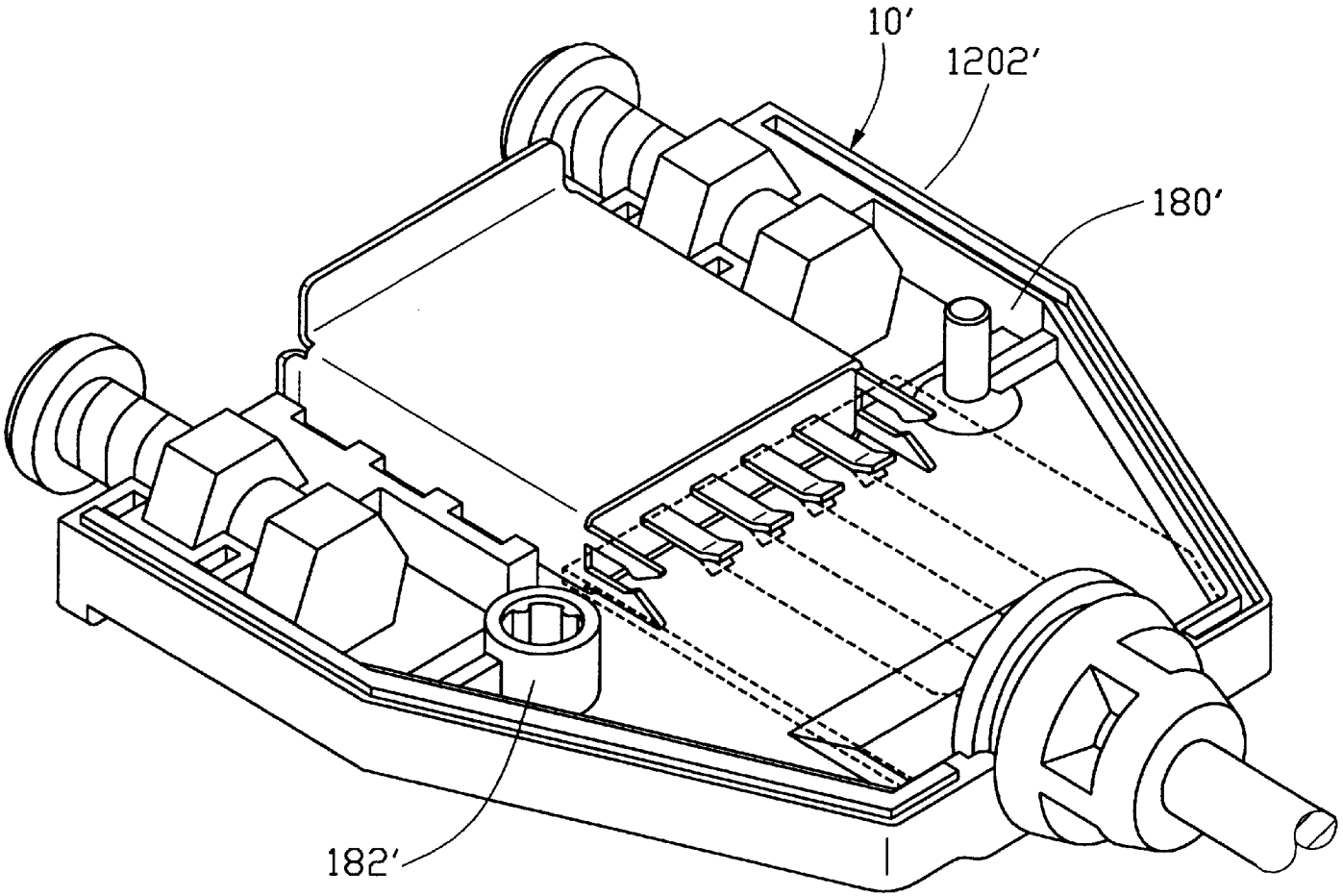
FIG. 9 is a sub-assembled perspective view of the panel mount electrical connector assembly of FIG. 8 showing a circuit board in dotted line attached therein.
Figure 11:
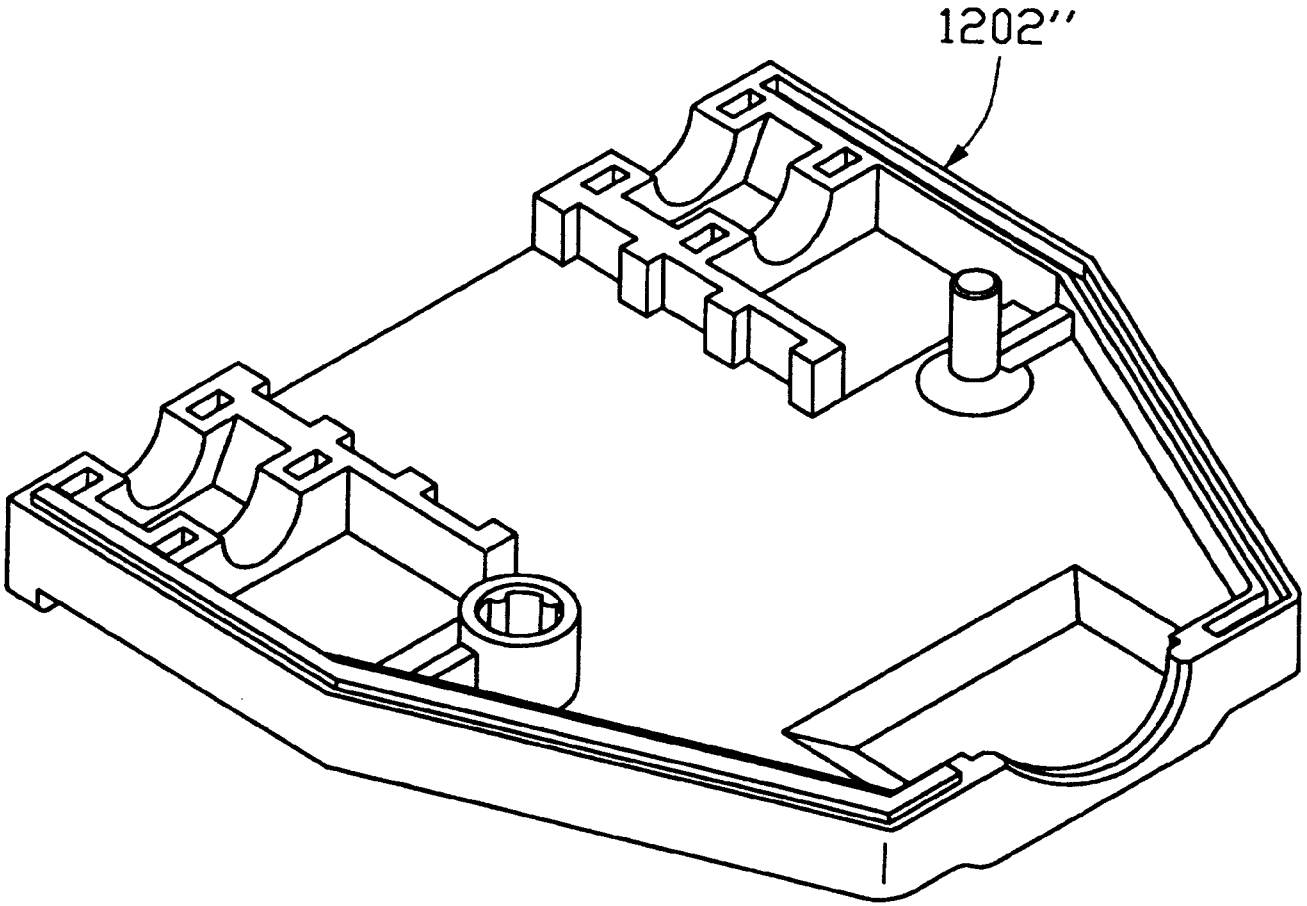
FIG. 11 is a front perspective view of a cover for used in the panel mount electrical connector assembly shown in either FIG. 9 or FIG. 10.

A second preferred embodiment in accordance with the present invention as shown in FIGS. 8, 9 & 11 indicates a plug type connector assembly 10' similar to the forgoing first embodiment expect the differences in the appearances. A pair of complementary posts 180', 182' are supposed to be formed within each cover 1202' for alignment before welding therebetween.

Figure 10:
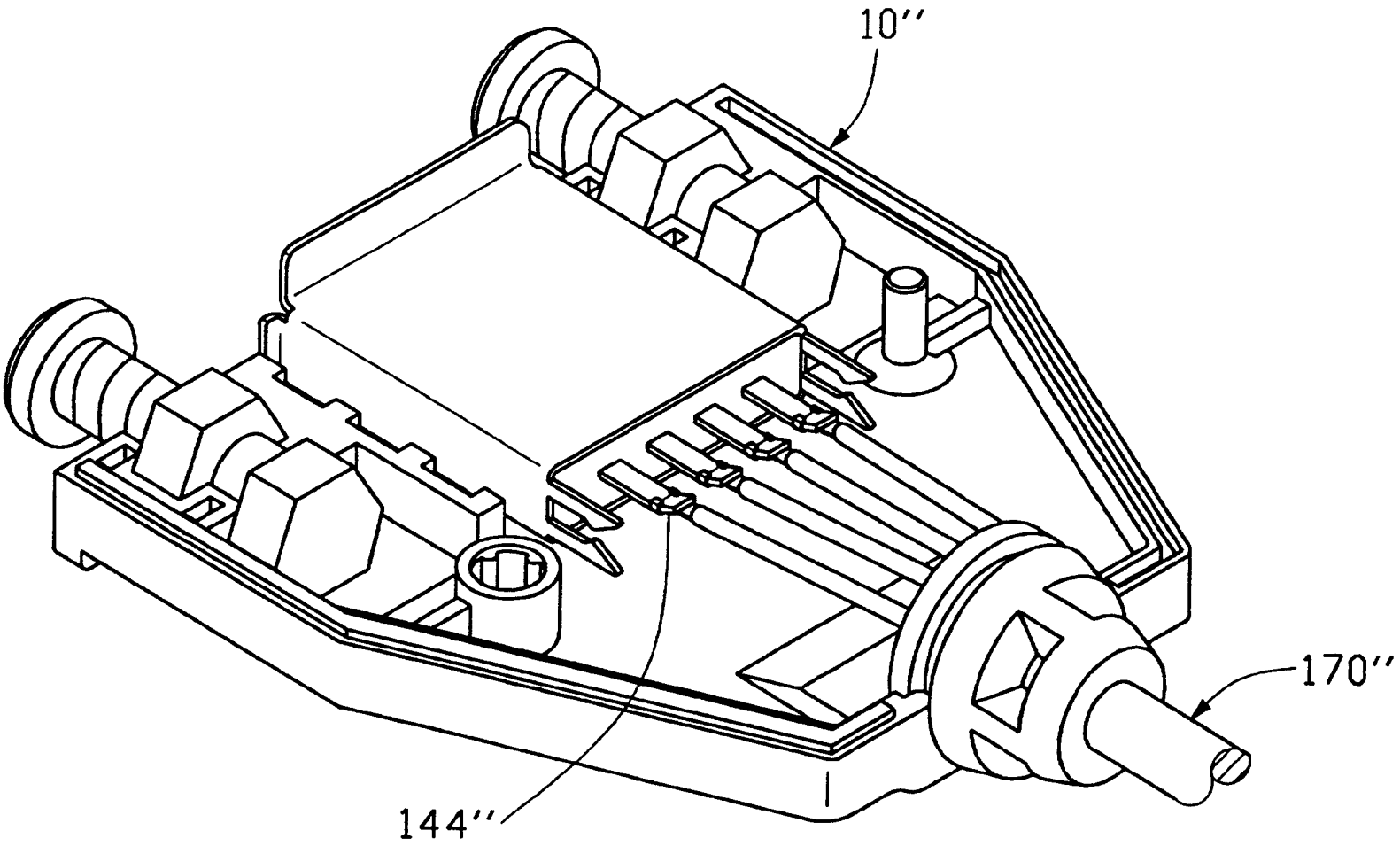
FIG. 10 is a sub-assembled perspective view of another panel mount electrical connector assembly of a third embodiment in accordance with the present invention showing a bunch of cables directly soldered into a plurality of contacts of the connector.
Figure 12:
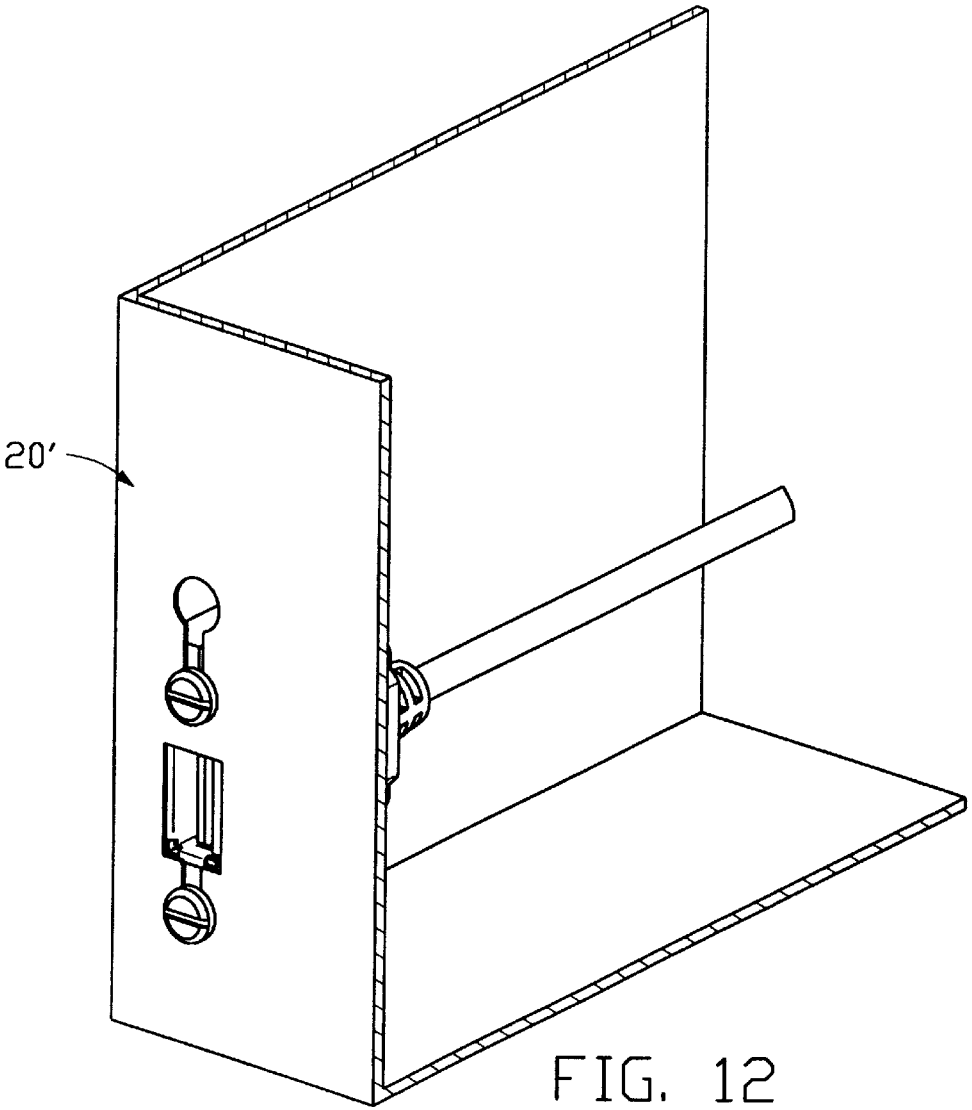
FIG. 12 is a front perspective view showing that the panel mount electrical connector assembly shown in either FIG. 9

A third preferred embodiment in accordance with the present invention as shown in FIG. 10 indicates a difference from the second embodiment, where a direct-soldering connection between the contacts 144" and the cables 170" replaces the interconnection of the circuit board. However, attachment of either the plug type connector assembly of the first or second embodiment to the panel 20' has the same result as shown in FIG. 12.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical connector assembly mounted on a panel of an instrument for coupling with a mating connector, comprising:

a connector unit adapted for contact with the mating connector, said connector unit receiving a plurality of contacts therein;

a bunch of cables electrically connected with the contacts of the connector unit; and an outer insulative housing enclosing the connector unit and defining at least a passageway along a front-to-rear direction adjacent to the connector unit, to partially receive a screw with opposite heads one of which is exposed out of the outer housing for being driven, and the other one is restricted, by a stop portion formed with the passageway, from removal of the entire screw out of the outer housing wherein the exposed head of the specific screw outside the outer housing hooks within a cutout defined on the panel thereby easily and speedily screwing the electrical connector assembly to the panel by driving the screw in;

wherein the outer housing is defined by upper and lower covers which are symmetrical;

wherein the connector unit further includes an inner housing and an inner conductive shielding shell around the inner housing;

wherein the inner shell of the connector unit has at least a grounding tab extending outside the outer housing to electrically contact the panel;

wherein the outer housing further encloses a circuit board electrically interconnecting between the connector unit and the cables;

wherein a fixture portion with an inner thread is fixedly located within a recess defined in the passageway of the outer housing and cooperates with an outer thread formed on the screw for the adjustable movement of the screw.

* * * * *